United States Patent [19]

Shoemaker

[11] Patent Number: 4,580,707

[45] Date of Patent: Apr. 8, 1986

[54] SPRING RELEASE ADJUSTABLE SHOULDER HOLSTER

[76] Inventor: Loren R. Shoemaker, 664 Chaparro Rd., Covina, Calif. 91724

[21] Appl. No.: 612,713

[22] Filed: May 21, 1984

[51] Int. Cl.[4] ..... F41C 33/02

[52] U.S. Cl. ..... 224/206; 224/911; 224/193

[58] Field of Search ..... 224/911, 206, 207, 192, 224/193, 912

[56] References Cited

U.S. PATENT DOCUMENTS

| | | | |
|---|---|---|---|
| 2,579,782 | 12/1951 | Booth | 224/911 X |
| 4,212,418 | 7/1980 | Bianchi | 224/911 X |
| 4,303,185 | 12/1981 | Shoemaker | 224/911 X |
| 4,480,776 | 11/1984 | Atkins, Sr. | 224/911 X |

*Primary Examiner*—Stephen Marcus
*Assistant Examiner*—David Voorhees
*Attorney, Agent, or Firm*—Boniard I. Brown

[57] ABSTRACT

A holster for handguns, such as pistols, where the holster positions the handgun generally in the armpit area of the owner with its muzzle pointed downwardly and its grip butt facing forwardly. The holster generally is of the rear opening spring loaded type, although since it is worn for across the body draw, it actually opens toward the front of the user. Each upper side of the folded construction of the holster extends upwardly to form overlapping tabs having means such as Velcro hooks and loops to hold the tabs together and connect the tabs to the opposite ends of a shoulder strap which forms the primary support for the holster. The ends of the shoulder strap also include Velcro for engagement with the Velcro of the holster tabs. The holster also includes an upper body elastic strap which extends from the shoulder strap about the body and back to retain the shoulder strap on the wearer's shoulder, and an optional belt strap which extends out the bottom of the holster for attachment to the user's waist belt.

15 Claims, 3 Drawing Figures

SPRING RELEASE ADJUSTABLE SHOULDER HOLSTER

BACKGROUND OF THE INVENTION

A law enforcement officer must be able to draw his handgun easily and quickly in order to carry out its timely and effective use. A plain clothes law enforcement officer must carry his handgun in unobtrusive spot. For that reason, male plain clothes officers tend to wear their handgun in a shoulder holster which fits underneath a coat, generally in the area of the armpit where its bulk is not easily recognized. Two problems are created by wearing a handgun in such a location. The officer must be able to quickly and easily remove the handgun when it is required, yet the holster must secure the handgun in a position which is comfortable. Since officers come all sizes, adjustment means must be provided so that the relative position of the holster body with respect to its supporting structure may be adjusted upwardly, downwardly or changed in angle to meet the particular physical configuration of a officer. Heretofore, vertical adjustment has been provided by conventional buckles which are, disadvantageous since they are lumpy and bulky and contain parts which may snag clothing or otherwise injure the clothing or person of the user and angular adjustment has been ignored. Therefore there has been a need to provide a shoulder holster which is relatively thin, having no bulky vertical adjustment buckles which secures a handgun to the user's body in a position allowing quick and easy draw of the handgun therefrom for use in emergency situations.

SUMMARY OF THE INVENTION

The present invention provides a rear breaking holster constructed from folded leather layers whose rear break is held together by means of a spring such as the spring shown in SHOEMAKER, U.S. Pat. No. 4,303,185. This spring holds the folded leather structure together, so that a handgun placed therein can be removed by grabbing the weapon's grip and pulling forwardly in the direction the grip butt extends to open the joining surfaces against the bias of a closure spring enclosed in the holster.

The present holster, like most shoulder holsters, is designed to be worn front to back; that is, although it is a rear opening holster, when worn it in fact opens in the direction the wearer is facing. The holster has a pair of facing tabs extending upwardly from each side. The tabs have facing surfaces covered by Velcro loops and hooks to form openable adjustment sheaths into which the opposite ends of a loop-shaped shoulder strap, also having Velcro hooks and loops, can be inserted at a chosen location and angle. The tabs of each sheath are connected together by the hooks and loops at those locations not separated by a strap end. When separated by a strap end, the tabs make a Velcro connection to both sides of the strap end. Therefore a smooth non-bulky adjustable attachment is provided. The loop-shaped shoulder strap is formed to drape over the shoulder of the user and is further secured to the user by a thin elastic strap which normally loops around the users body. This prevents the shoulder strap from sliding off the user's shoulder. An optional belt loop can also be extended downwardly from the holster adjacent its barrel retaining portion to the user's belt.

It is therefore an object of the present invention to provide a shoulder holster which is adjustable without resort to uncomfortable buckles and straps.

Another object is to provide a spring-opening shoulder holster which can be adjusted to be worn in suitable locations for concealment and quick usage of a handgun contained therein.

Another object is to provide a shoulder holster which is relatively economical to construct yet has desirable security and adjustment features.

These and other objects and advantages of the present invention will become apparent to those skilled in the art after considering the following detailed specification together with the accompanying drawing wherein:

DETAILED DESCRIPTION OF THE PRESENT EMBODIMENT

Figure 1:
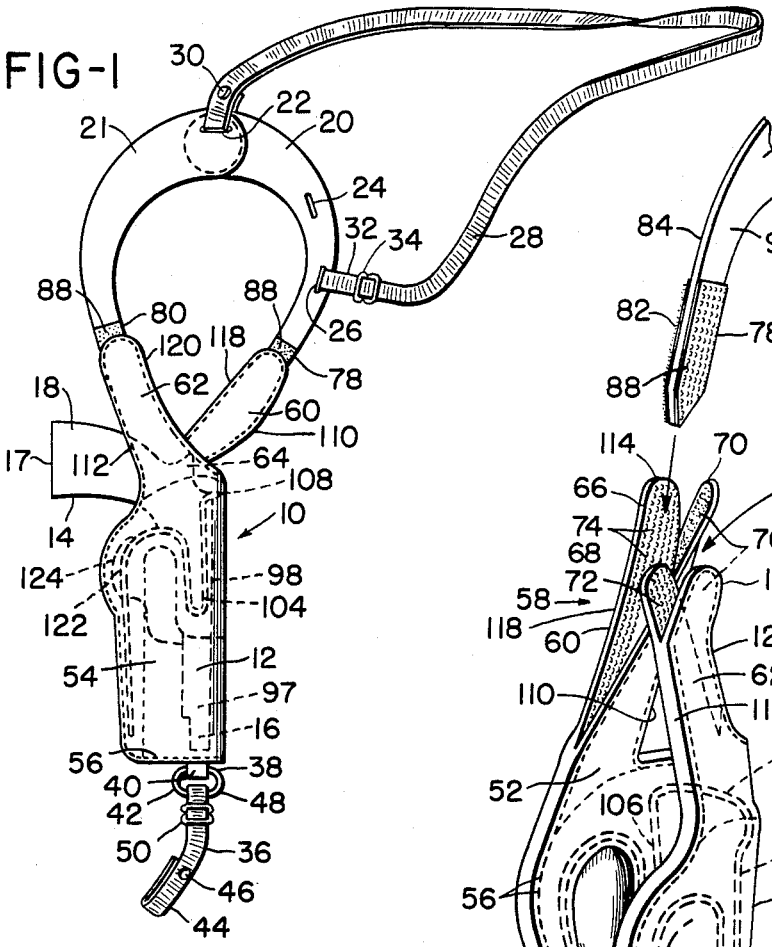
FIG. 1 is a side view of a shoulder holster constructed according to the present invention.
Figure 2:
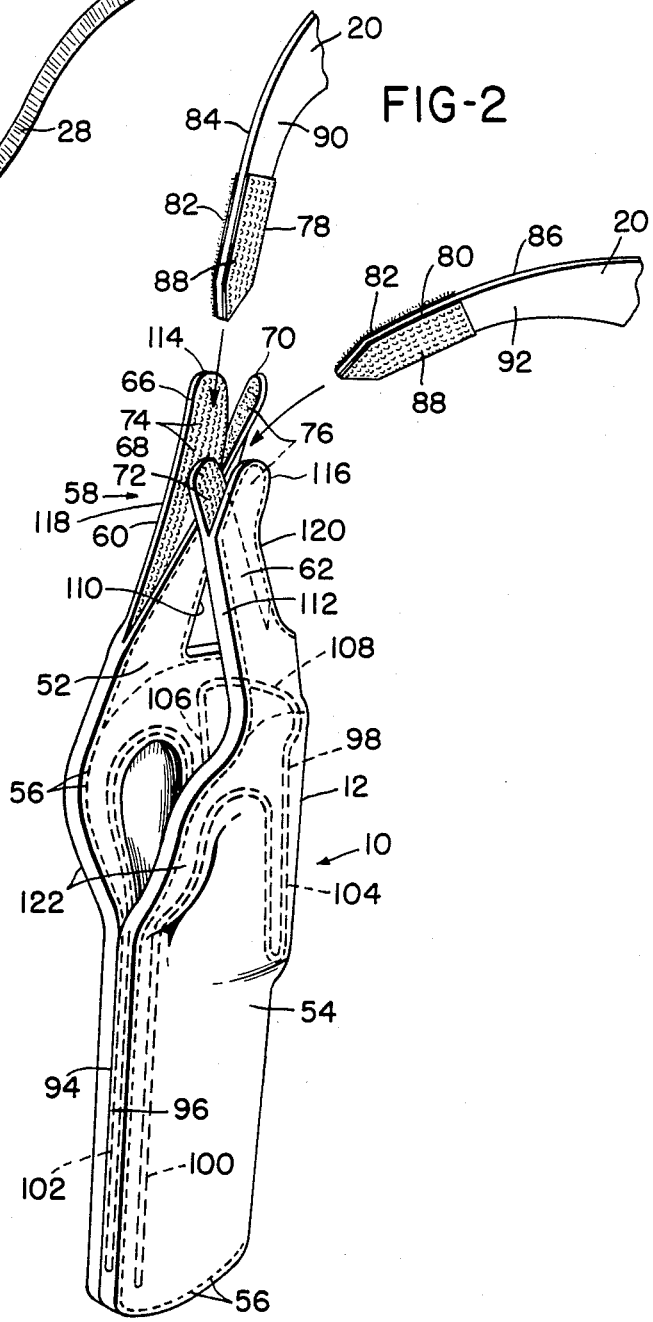
FIG. 2 is an enlarged detail perspective view showing the adjustment features of the present invention.

Referring to the drawings more particularly by reference numbers, number 10 in FIG. 1 refers to a holster constructed according to the present invention. The holster 10 includes a main sheath 12 which supports and retains a pistol 14 inserted therein with its muzzle 16 pointed downwardly and the butt 17 of its grip 18 pointed in the direction that the user is facing. The holster 10 is connected to the user by means of a loop-shaped shoulder strap 20 which fits about a user's shoulder nestling the main sheath 12 and pistol 14 in the general location of the user's armpit. When configured as shown in FIG. 1, the holster 10 would be located near the user's left armpit as is typical for a right handed user. The holster 10 also can be worn on the right shoulder by flipping the strap 20 over so that its usual upper surface 21 becomes its lower surface.

Slots 22, 24 and 26 are provided in the strap 20 for attachment of an elastic band 28 which is shown is attached through slot 22 by means of a snap 30 and slot 26 by means of an adjustment loop 32 and buckle 34. The elastic band assures that the shoulder strap 20 does not ride out and off the user's shoulder during strenuous activity. An optional elastic belt strap 36 attached to the lower portion 38 of the sheath 12 by means of a loop 40 and a ring 42 can be used to secure the lower portion 38 of the holster 10 to a pants belt by means of a lower loop 44 and snap 46. The belt 36 is connected to the ring 42 by means of an adjustable loop 48 and slip buckle 50 of conventional construction.

The sheath 12 generally is constructed of an inner layer 52 and an outer layer 54 of flat leather held together by stitching 56. At the upper portion 58 of the sheath 12 a pair of upwardly extending adjustment sheaths are formed by not completely stitching the inner and outer layers of leather 52 and 54 together to form an inner adjustment sheath 60 and an outer adjustment sheath 62. It should be noted that the outer adjustment sheath 62 extends upwardly and in the direction of the grip 18 while the inner adjustment sheath 60 extends upwardly and away from the grip 18. The leverage exerted on the outer adjustment sheath 62 by the strap 20 connected thereto tends to hold the main sheath 12 together while the inner adjustment sheath 60 extends adjacent the hammer 64 of the pistol 16 to prevent its engagement with the user's side.

The adjustment sheaths 60 and 62 each have outwardly facing inner surfaces 66 and 68 and inwardly facing inner surfaces 70 and 72 respectively. Surfaces 66 and 70 and 68 and 72 face each other and are engageable by means of mechanical fasteners such as Velcro loops 74 and hooks 76 thereon. When worn as shown, the loops 74 face outwardly while the hooks 76 face inwardly. The opposite ends 78 and 80 of the shoulder strap 20 are designed to fit within the sheaths 60 and 62 respectively each also having attachment means such as inwardly facing hooks 82 on the inside surface 84 and 86 thereof and loops 88 on the outer surface 90 and 92 thereof. When the ends 78 and 80 are inserted within the sheaths 60 and 62. The outwardly facing loops 74 and 88 and inwardly facing hooks 76 and 82 thereof fasten together so that in those portions of the adjustment sheaths 60 and 62 where the ends 78 and 80 do not extend, loops 74 and hooks 76 hold the sheaths 60 and 62 together. In those generally upper areas in which the ends 78 and 80 extend, the loops 74 attach to hooks 82 and the hooks 76 attach to loops 88 thereby providing smoothly contoured attachments between the sheath 12 and the strap 20. Since the ends 78 and 80 can be attached at any desired location and at a reasonable range of angles within the adjustment sheaths 60 and 62, the holster 10 can be worn by users of various builds in locations which are comfortable for the particular user and provide easy access to the pistol 14.

Figure 3:
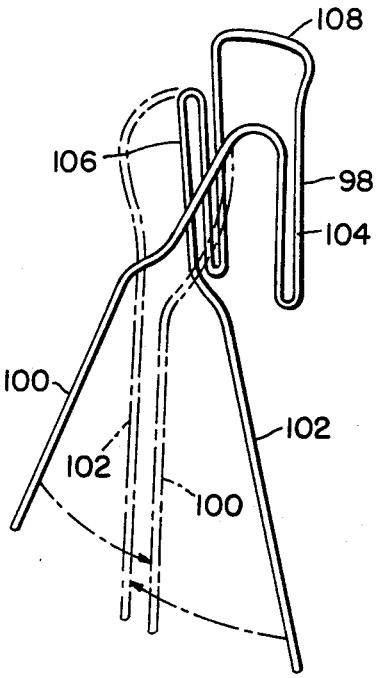
FIG. 3 is a perspective view showing the spring installed in the holster of FIGS. 1 and 2 in its free and installed positions.

The main sheath is held together at its mating opening surfaces 94 and 96 forwardly from the barrel 97 of the pistol 14 by a spring 98 positioned between the inner and outer leather layers 52 and 54. The spring 98 is shown in its natural condition in solid outline and its inserted condition in broken line in FIG. 3. It should be noted that the spring 98 in addition to its two downwardly extending leg portions 100 and 102 which extend adjacent to the mating surfaces 94 and 96 to hold them together includes U-shaped stiffener portions 104 and 106 in each leg 100 and 102 respectively connected by a central portion 108.

It should be noted that the lower side edges 110 and 112 of the adjustment sheaths 60 and 62 are stitched closer to the tips 114 and 116 thereof than the upper edges 118 and 120 thereof. This allows for easy insertion of the ends 78 and 80 within the sheaths 60 and 62 without substantially weakening the connection therebetween.

When the pistol 14 is to be withdrawn from the holster 10, the user reaches over with his opposite side hand across his body and grabs the grip 18. The user then pulls the pistol forwardly, allowing its muzzle 16 to rotate upwardly as the surfaces 94 and 96 are spread by the extraction force to release the pistol 14. An upper portion 122 of the holster 10 covers the trigger guard 124 until the pistol 14 has started to clear the holster 10. The pistol 14 is drawn further until its muzzle 16 is facing forwardly on the opposite side of the user from the holster 10.

Thus there has been shown and described a novel spring loaded adjustable shoulder holster which fulfills all of the objects and advantages sought therefor. Many changes, modification, variations and other uses and applications of the subject invention will however become apparent to those skilled in the art after considering this specification together with the accompanying drawings. All such changes, modifications, variations and other uses and applications which do not depart from the spirit and scope of the invention are deemed to be covered by the invention which is limited only by the claims which follows.

What is claimed is:

1. A shoulder holster for a handgun including:

a main sheath for storing the handgun having:

a first pair of tabs forming a first adjustment sheath;

a second pair of tabs forming a second adjustment sheath;

first adjustable attachment means positioned within said first adjustment sheath; and second adjustable attachment means positioned within said second adjustment sheath; and a shoulder strap having:

a first end with third adjustable attachment means thereon in engagement with said first attachment means within said first adjustment sheath to hold said first end within said first adjustment sheath; and a second end with fourth adjustable attachment means thereon in engagement with said second attachment means within said second adjustment sheath to hold said second end within said second adjustment sheath thereby adjustably retaining said main sheath to said shoulder strap.

2. The shoulder holster defined in claim 1 wherein said first adjustable attachment means and said third adjustable attachment means each include:

a plurality of hooks facing in a first direction; and a plurality of loops facing in a second direction generally opposite to said first direction.

3. The shoulder holster defined in claim 1 wherein said first adjustable attachment means include:

a first plurality of hooks facing in a first direction; and a first plurality of loops facing in a second direction generally opposite to said first direction, said second adjustable attachment means including:

a second plurality of hooks facing in said first direction; and a second plurality of loops facing in said second direction, said third adjustable attachment means including:

a third plurality of hooks facing in said first direction; and a third plurality of loops facing in said second direction, and said fourth adjustable attachment means including:

a fourth plurality of hooks facing in said first direction; and a fourth plurality of loops facing in said second direction, whereby said loops and hooks engage with each other to adjustably retain said main sheath to said shoulder strap.

4. The shoulder holster defined in claim 1 wherein said main sheath includes:

first and second layers of material, said first pair of tabs having:

a first tab formed by an upper portion of said first layer; and a second tab formed by an upper portion of said second layer, and said second pair of tabs having:

a third tab formed by an upper portion of said first layer; and a fourth tab formed by an upper portion of said second layer, said first end being inserted between and separating at least a portion of said first and second tabs and said second end being inserted between and separating at least a portion of said third and fourth tabs.

5. The shoulder holster defined in claim 4 wherein said first adjustment means include:

a first plurality of hooks facing in a first direction from said first tab; and a first plurality of loops facing in a second direction generally opposite to said first direction from said second tab, and wherein said third adjustable attachment means include:

a third plurality of hooks facing in said first direction from said first end; and a third plurality of loops facing in said second direction generally opposite to said first direction from said first end, said first plurality of hooks and said third plurality of loops facing each other and engaging each other in locations where said shoulder strap first end separates said first plurality of hooks and said first plurality of loops, said first plurality of loops and said third plurality of hooks facing each other and engaging each other in locations where said shoulder strap first end separates said first plurality of hooks and said first plurality of loops, and said first plurality of hooks and said first plurality of loops facing each other and engaging each other where not separated by said shoulder strap first end to hold said first adjustment sheath together.

6. The shoulder holster defined in claim 5 wherein said second adjustment means include:

a second plurality of hooks facing in said first direction from said fourth tab; and a second plurality of loops facing in said second direction from said third tab, and wherein said fourth adjustable attachment means include:

a fourth plurality of hooks facing in said first direction from said second end; and a fourth plurality of loops facing in said second direction from said second end, said second plurality of hooks and said fourth plurality of loops facing each other and engaging each other in locations where said shoulder strap second end separates said second plurality of hooks and said second plurality of loops, said second plurality of loops and said fourth plurality of hooks facing each other and engaging each other in locations where said shoulder strap second end separates said second plurality of hooks and said second plurality of loops, and said second plurality of hooks and said second plurality of loops facing each other and engaging each other where not separated by said shoulder strap second end to hold said second adjustment sheath together.

7. The shoulder holster defined in claim 4 wherein said first adjustment sheath includes:

a first upwardly extending lower edge;

a first upwardly extending upper edge; and a first upper tip, said first upwardly extending lower edge being formed by connecting said first and second layers of material closer to said first upper tip than said first and second layers of material are connected at said first upwardly extending upper edge.

8. The shoulder holster defined in claim 7 wherein said second adjustment sheath includes:

a second upwardly extending lower edge;

a second upwardly extending upper edge; and a second upper tip, said second upwardly extending lower edge being formed by connecting said first and second layers of material closer to said second upper tip than said first and second layers of material are connected at said second upwardly extending upper edge.

9. The holster defined in claim 7 wherein said outer adjustment sheath includes:

a second upwardly extending lower edge;

a second upwardly extending upper edge; and a second upper tip, said second upwardly extending lower edge being formed by connecting said inner and outer layers of material closer to said second upper tip than said inner and outer layers of material are connected at said second upwardly extending upper edge.

10. The holster defined in claim 9 wherein said first adjustable attachment means include:

a first plurality of hooks facing in a first direction; and a first plurality of loops facing in a second direction generally opposite to said first direction, said second adjustable attachment means including:

a second plurality of hooks facing in said first direction; and a second plurality of loops facing in said second direction, said third adjustable attachment means including:

a third plurality of hooks facing in said first direction; and a third plurality of loops facing in said second direction, and said fourth adjustable attachment means including:

a fourth plurality of hooks facing in said first direction; and a fourth plurality of loops facing in said second direction, whereby said loops and hooks engage with each other.

11. The holster defined in claim 9 wherein said first adjustment means include:

a first plurality of hooks facing in a first direction from said outer tab of said inner adjustment sheath; and a first plurality of loops facing in a second direction generally opposite to said first direction from said inner tab of said inner adjustment sheath, and wherein said third adjustable attachment means include:

a third plurality of hooks facing in said first direction from said first end; and a third plurality of loops facing in said second direction generally opposite to said first direction from said first end, said first plurality of hooks and said third plurality of loops facing each other and engaging each other in locations where said strap first end separates said first plurality of hooks and said first plurality of loops, said first plurality of loops and said third plurality of hooks facing each other and engaging each other in locations where said strap first end separates said first plurality of hooks and said first plurality of loops, and said first plurality of hooks and said first plurality of loops facing each other and engaging each other where not separated by said strap first end to hold said inner adjustment sheath together.

12. The holster defined in claim 11 wherein said second adjustment means include:

a second plurality of hooks facing in said first direction from said outer tab of said outer adjustment sheath; and a second plurality of loops facing in said second direction from said inner tab of said outer adjustment sheath, and wherein said fourth adjustable attachment means include:

a fourth plurality of hooks facing in said first direction from said second end; and a fourth plurality of loops facing in said second direction from said second end, said second plurality of hooks and said fourth plurality of loops facing each other and engaging each other in locations where said strap second end separates said second plurality of hooks and said second plurality of loops, said second plurality of loops and said fourth plurality of hooks facing each other and engaging each other in locations where said strap second end separates said second plurality of hooks and said second plurality of loops, and said second plurality of hooks and said second plurality of loops facing each other and engaging each other where not separated by said strap second end to hold said outer adjustment sheath together.

13. A holster including:

a main sheath for storing a handgun having:

a first pair of tabs forming an inner adjustment sheath;

a second pair of tabs forming an outer adjustment sheath;

first adjustable attachment means positioned within said inner adjustment sheath; and second adjustable attachment means positioned within said outer adjustment sheath; and a strap having:

a first end with third adjustable attachment means thereon in engagement with said first attachment means within said inner adjustment sheath to hold said first end within said inner adjustment sheath; and a second end with fourth adjustable attachment means thereon in engagement with said second attachment means within said outer adjustment sheath to hold said second end within said outer adjustment sheath thereby adjustably retaining said main sheath to said strap.

14. The holster defined in claim 13 wherein said main sheath includes:

inner and outer layers of material, said first pair of tabs having:

an inner tab formed by an upper portion of said outer layer; and a outer tab formed by an upper portion of said inner layer, and said second pair of tabs having:

an inner tab formed by an upper portion of said inner layer; and a outer tab formed by an upper portion of said outer layer, said first end being inserted between and separating at least a portion of said first and second tabs and said second end being inserted between and separating at least a portion of said third and fourth tabs.

15. The holster defined in claim 14 wherein said inner adjustment sheath includes:

a first upwardly extending lower edge;

a first upwardly extending upper edge; and a first upper tip, said first upwardly extending lower edge being formed by connecting said inner and outer layers of material closer to said first upper tip than said inner and outer layers of material are connected at said first upwardly extending upper edge.

* * * * *